US011119432B2

(12) United States Patent
Nishimura

(10) Patent No.: US 11,119,432 B2
(45) Date of Patent: Sep. 14, 2021

(54) IMAGE FORMING APPARATUS

(71) Applicant: KYOCERA Document Solutions Inc., Osaka (JP)

(72) Inventor: Takatoshi Nishimura, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 199 days.

(21) Appl. No.: 16/510,297

(22) Filed: Jul. 12, 2019

(65) Prior Publication Data

US 2020/0026231 A1 Jan. 23, 2020

(30) Foreign Application Priority Data

Jul. 19, 2018 (JP) ..... JP2018-135835

(51) Int. Cl.
*G03G 15/00* (2006.01)
*B65H 29/52* (2006.01)
*B65H 5/36* (2006.01)

(52) U.S. Cl.
CPC ..... *G03G 15/6502* (2013.01); *B65H 5/36* (2013.01); *B65H 29/52* (2013.01); *G03G 15/657* (2013.01); *G03G 2215/00679* (2013.01); *G03G 2215/2058* (2013.01)

(58) Field of Classification Search
CPC ..... G03G 15/6502
USPC ..... 399/381
See application file for complete search history.

(56) References Cited

U.S. PATENT DOCUMENTS 4,349,190 A * 9/1982 Kaneko ..... B65H 31/24 271/194
5,010,363 A * 4/1991 Higashio ..... G03G 15/6579 399/19
5,418,606 A * 5/1995 Kikuchi ..... G03G 15/326 399/381
2016/0185543 A1* 6/2016 Osada ..... B65H 5/36 271/225
2017/0144852 A1* 5/2017 Sato ..... B65H 5/062
2017/0267474 A1* 9/2017 Omichi ..... B65H 5/38
2018/0208419 A1* 7/2018 Mizuta ..... B65H 5/38
2018/0362283 A1* 12/2018 Yamamoto ..... B65H 31/24

FOREIGN PATENT DOCUMENTS

JP H10-194517 A 7/1998

* cited by examiner

*Primary Examiner* — Anthony H Nguyen
(74) *Attorney, Agent, or Firm* — Studebaker & Brackett PC

(57) ABSTRACT

In an image forming apparatus, a conveyance section forms a conveyance path and conveys a sheet in a conveyance direction. The conveyance section includes a conveyance roller for rotating around a roller shaft extending in a direction orthogonal to the conveyance direction, and a guide member. The guide member includes a first guide member for rotating around a first axial line to open/close with respect to a first partial region of the conveyance path, and a second guide member for rotating around a second axial line to open/close with respect to a second partial region different from the first partial region. The first axial line extends in a direction parallel to a longitudinal direction of the roller shaft. The second axial line extends in a direction intersecting with the longitudinal direction. The first guide member opens in conjunction with an opening action of the second guide member.

8 Claims, 7 Drawing Sheets

IMAGE FORMING APPARATUS

INCORPORATION BY REFERENCE

The present application claims priority under 35 U.S.C. § 119 to Japanese Patent Application No. 2018-135835, filed on Jul. 19, 2018. The contents of this application are incorporated herein by reference in their entirety.

BACKGROUND

The present disclosure relates to image forming apparatuses.

Some image forming apparatuses that have a conveyance guide which forms a conveyance path are known. Among such image forming apparatuses is one that has an upper conveyance guide and a lower conveyance guide which are openable and closeable with respect to a middle tray. In one image forming apparatus, the upper and lower conveyance guides rotate around their respective axes of rotation, which are parallel to each other. In one image forming apparatus, the upper and lower conveyance guides are linked together by a resin tape, and the lower conveyance guide is also opened in conjunction with the rotation of the upper conveyance guide. In one image forming apparatus, when the upper and lower conveyance guides are opened, a jammed sheet can be removed from the middle tray.

SUMMARY

An image forming apparatus according to the present disclosure includes an image forming section and a conveyance section. The image forming section forms an image on a sheet. The conveyance section forms a conveyance path for the sheet and conveys the sheet in a conveyance direction. The conveyance section includes a conveyance roller configured to rotate around a roller shaft as a center, the roller shaft extending in a direction orthogonal to the conveyance direction, and a guide member. The guide member includes a first guide member configured to rotate around a first axial line as a pivot to open and close with respect to a first partial region of an entire region of the conveyance path, and a second guide member configured to rotate around a second axial line as a pivot to open and close with respect to a second partial region of the entire region, the second partial region being different from the first partial region. The first axial line extends in a direction parallel to a longitudinal direction of the roller shaft. The second axial line extends in a direction intersecting with the longitudinal direction. The first guide member opens in conjunction with an opening action of the second guide member.

DETAILED DESCRIPTION

Figure 1:
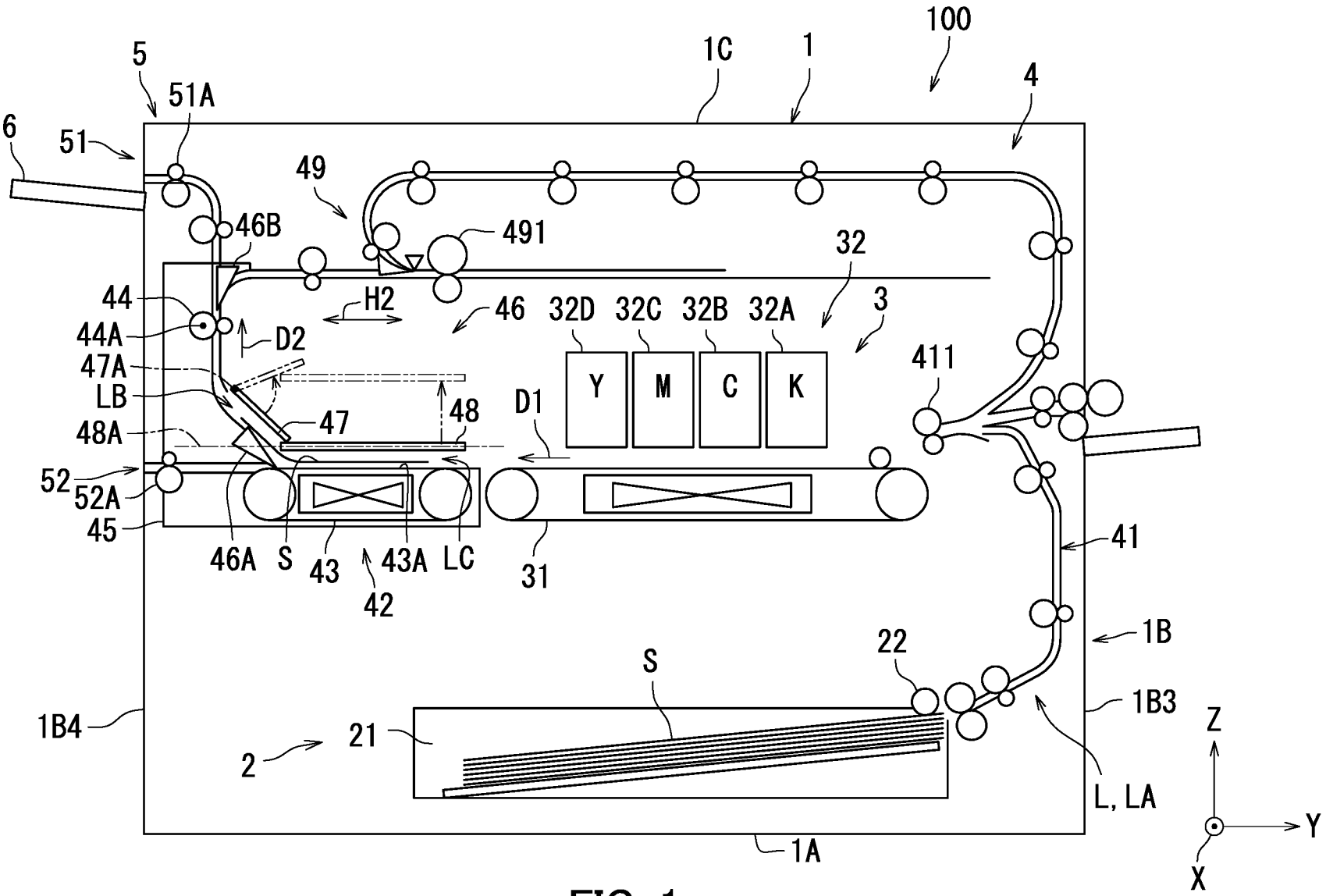
FIG. 1 is a diagram showing an image forming apparatus according to an embodiment of the present disclosure.

An embodiment of the present disclosure will now be described with reference to the accompanying drawings. It should be noted that the same or corresponding parts are indicated by the same reference characters and will not redundantly be described. In this embodiment, the X-axis and the Y-axis are parallel to the horizontal plane, and the Z-axis is parallel to the vertical axis. The X-axis, the Y-axis, and the Z-axis are orthogonal to each other. As used herein, the terms "above" and "upper" and the terms "below" and "lower" refer to relative positions above and below, respectively, a given point or element in the direction of the vertical axis unless otherwise specified. As used herein, the terms "up" and "upward" and the terms "down" and "downward" refer to directions along the vertical axis that point to a higher position and a lower position, respectively, unless otherwise specified.

An embodiment of an image forming apparatus 100 according to the present disclosure will be described with reference to FIG. 1. FIG. 1 is a diagram showing the image forming apparatus 100. The image forming apparatus 100 is, for example, a printer, photocopier, or multifunction peripheral. In the description that follows, as an example, it is assumed that the image forming apparatus 100 is an inkjet-recording type color printer.

The image forming apparatus 100 includes a body housing 1, a feeding section 2, an image forming section 3, a conveyance mechanism 4, an exit section 5, and an exit tray 6. The body housing 1 accommodates the feeding section 2, the image forming section 3, the conveyance mechanism 4, and the exit section 5.

The feeding section 2 is located at a lower position in the body housing 1. The feeding section 2 includes a feeding cassette 21 and a feeding roller 22. The feeding cassette 21 stores a sheet S, and is removably attached to the body housing 1. The feeding section 2 feeds the sheet S to the conveyance mechanism 4. The sheet S is made of, for example, paper or synthetic resin.

The conveyance mechanism 4 forms an entire region LA of a conveyance path L for the sheet S. The conveyance path L is formed by various frame members, guide members, roller members, belt members, etc. The entire region LA is, for example, a space in which the sheet S is conveyed. The entire region LA includes a first partial region LB and a second partial region LC. The second partial region LC is different from the first partial region LB. For example, the second partial region LC is located adjacent to and connected to the first partial region LB. The conveyance mechanism 4 conveys the sheet S in a conveyance direction along the conveyance path L. Specifically, the conveyance mechanism 4 conveys the sheet S fed from the feeding section 2. The conveyance mechanism 4 includes a first conveyance section 41, a second conveyance section 42, and a reverse conveyance section 49.

The first conveyance section 41 conveys the sheet S fed from the feeding section 2 to the image forming section 3. The first conveyance section 41 includes a registration roller pair 411. The registration roller pair 411 sends out the sheet S to the image forming section 3 according to image formation timing.

The second conveyance section 42 includes a second conveyance belt 43, a conveyance roller 44, a frame member 45, and a guide member 46. The second conveyance section 42 is equivalent to an example of the "conveyance section." Note that the frame member 45 is described in detail with reference to FIG. 4 below.

The second conveyance belt 43 is an endless belt that is supported by a plurality of rollers with tension applied to the belt. The second conveyance belt 43 is driven to convey the sheet S in a conveyance direction D1 (in FIG. 1, the counterclockwise direction) with the sheet S placed on a placement surface 43A.

The conveyance roller 44 includes a roller shaft 44A. The roller shaft 44A extends in a direction orthogonal to a conveyance direction D2. The conveyance roller 44 rotates around the roller shaft 44A as a center. For example, the conveyance roller 44 conveys the sheet S toward a first exit section 51 or the reverse conveyance section 49.

In general, when maintenance such as clearing jams is performed on an image forming apparatus, it may be necessary to perform an operation of opening and closing each of the two conveyance guides. In addition, at some sites where maintenance is required, the directions in which the axes of rotation of the two conveyance guides to be operated extend may intersect with each other.

In the present disclosure, the guide member 46 guides the sheet S in the conveyance direction. The guide member 46 includes a first guide member 47, a second guide member 48, a first branching guide member 46A, and a second branching guide member 46B. The first guide member 47 rotates around a first axial line 47A as a pivot. The first axial line 47A extends in a direction (also hereinafter referred to as a "first direction") parallel to the longitudinal direction of the roller shaft 44A. The first guide member 47 opens and closes with respect to the first partial region LB of the conveyance path L. The first guide member 47 can contact the second guide member 48. The first guide member 47 opens in conjunction with the opening action of the second guide member 48.

As used herein, a state in which the first guide member 47 is open with respect to the first partial region LB and a state in which the first guide member 47 is closed with respect to the first partial region LB are also referred to as an "open state of the first guide member 47" and a "closed state of the first guide member 47," respectively. A rotation of the first guide member 47 that causes the first guide member 47 to move upward to open with respect to the first partial region LB is also referred to as a "forward rotation (of the first guide member 47)," and a rotation of the first guide member 47 that causes the first guide member 47 to move downward to close with respect to the first partial region LB is also referred to as a "backward rotation (of the first guide member 47)."

The second guide member 48 rotates around a second axial line 48A as a pivot. The second axial line 48A extends in a direction H2 (also hereinafter referred to as a "second direction H2") intersecting with the longitudinal direction of the roller shaft 44A. The second guide member 48 opens and closes with respect to the second partial region LC. The opening action of the second guide member 48 by rotating around the second axial line 48A as a pivot causes the second guide member 48 to push the first guide member 47 upward.

A state in which the second guide member 48 is open with respect to the second partial region LC and a state in which the second guide member 48 is closed with respect to the second partial region LC are also referred to as an "open state of the second guide member 48" and a "closed state of the second guide member 48," respectively. A rotation of the second guide member 48 that causes the second guide member 48 to move upward to open with respect to the second partial region LC is also referred to as a "forward rotation (of the second guide member 48)," and a rotation of the second guide member 48 that causes the second guide member 48 to move downward to close with respect to the second partial region LC is also referred to as a "backward rotation (of the second guide member 48)."

The first branching guide member 46A branches the conveyance path L into a conveyance path toward the first exit section 51 and a conveyance path toward the second exit section 52. The first branching guide member 46A is, for example, a flap member. The first branching guide member 46A is located downstream of the second partial region LC in the conveyance direction D1, facing the first guide member 47 when the first guide member 47 is in the closed state. The first branching guide member 46A is driven to convey the sheet S toward the first exit section 51 or the second exit section 52.

The second branching guide member 46B branches the conveyance path L into a conveyance path toward the first exit section 51 and a conveyance path toward the reverse conveyance section 49. The second branching guide member 46B is, for example, a flap member. The second branching guide member 46B is located downstream of the conveyance roller 44 in the conveyance direction D2. The second branching guide member 46B is driven to convey the sheet S toward the first exit section 51 or the reverse conveyance section 49.

For example, the second conveyance section 42 conveys the sheet S to the first exit section 51, the reverse conveyance section 49, or the second exit section 52. Specifically, in the case where the sheet S is to be output to the exit tray 6, the second conveyance section 42 conveys the sheet S to the first exit section 51. In the case where the sheet S is to be reversed, the second conveyance section 42 conveys the sheet S to the reverse conveyance section 49. In the case where the sheet S is to be output from the second exit section 52 to the outside of the image forming apparatus 10, the second conveyance section 42 conveys the sheet S to the second exit section 52.

The reverse conveyance section 49 reverses the sheet S sent from the second conveyance section 42, and conveys the sheet S to the registration roller pair 411. The reverse conveyance section 49 includes a reverse roller pair 491. The reverse roller pair 491 is configured to be capable of rotating forward and backward. The registration roller pair 411 sends out the sheet S sent from the reverse conveyance section 49 to the image forming section 3 according to image formation timing.

The image forming section 3 is located above the feeding section 2. The image forming section 3 forms an image on the sheet S. The image forming section 3 includes a first conveyance belt 31 and a recording head 32. The recording head 32 includes four recording heads 32A, 32B, 32C, and 32D.

The first conveyance belt 31 conveys the sheet S sent from the registration roller pair 411 in the conveyance direction D1 of the sheet S. Specifically, the first conveyance belt 31 sends out the sheet S through below the recording head 32 toward the second conveyance section 42.

The recording head 32A stores black ink. The recording head 32B stores cyan ink. The recording head 32C stores magenta ink. The recording head 32D stores yellow ink. The recording heads 32A-32D are used to form a color image on the sheet S.

The exit section 5 includes the first exit section 51 and the second exit section 52. The first exit section 51 outputs the sheet S conveyed from the second conveyance section 42 to the exit tray 6. The first exit section 51 includes a first exit roller pair 51A. The first exit roller pair 51A outputs the sheet S to the exit tray 6.

The second exit section 52 outputs the sheet S conveyed from the second conveyance section 42 in the conveyance direction D1, to the outside of the image forming apparatus 10. The second exit section 52 includes a second exit roller pair 52A. The second exit roller pair 52A outputs the sheet S to the outside of the image forming apparatus 10. The second exit section 52 serves as, for example, a straight exit section. For example, the straight exit section outputs a sheet S (e.g., thick paper) that is not easily bent and is fed from the manual feed tray, in the conveyance direction D1, with the sheet S moving in a straight line.

Placed on the exit tray 6 is the sheet S output from the first exit roller pair 51A. A plurality of sheets S can be placed on the exit tray 6.

The body housing 1 has a frame and a cladding member covering an outer surface of the frame. The body housing 1 is in the shape of, for example, a generally rectangular parallelepiped. Specifically, the body housing 1 includes a bottom wall portion 1A, a side wall portion 1B, and a top wall portion 1C. The bottom wall portion 1A is a bottom wall of the body housing 1.

The side wall portion 1B is disposed in a vertical position at the four sides of the bottom wall portion 1A. The side wall portion 1B includes a first side wall portion, a second side wall portion, a third side wall portion 1B3, and a fourth side wall portion 1B4. The first side wall portion, which is orthogonal to the third and fourth side wall portions 1B3 and 1B4, is located facing the second side wall portion with the second conveyance section 42 interposed therebetween. The third side wall portion 1B3 is located in parallel to and facing the fourth side wall portion 1B4 with the image forming section 3 and the second conveyance section 42 interposed therebetween. The fourth side wall portion 1B4 is located downstream of the third side wall portion 1B3 in the conveyance direction D1 (on the left side of FIG. 1). Note that the first and second side wall portions are described in detail with reference to FIG. 4 below.

The top wall portion 1C, which is connected to an upper end portion of the side wall portion 1B, forms the top wall of the body housing 1.

As described above with reference to FIG. 1, in this embodiment, the image forming apparatus 100 includes the image forming section 3 and the conveyance mechanism 4. The image forming section 3 forms an image on the sheet S. The conveyance mechanism 4 forms the conveyance path L and conveys the sheet S in the conveyance direction. The second conveyance section 42 of the conveyance mechanism 4 includes the conveyance roller 44, the first and second guide members 47 and 48. The first guide member 47 rotates around the first axial line 47A as a pivot to open and close with respect to the first partial region LB of the conveyance path L. The first axial line 47A extends in a direction parallel to the longitudinal direction of the roller shaft 44A of the conveyance roller 44. The second guide member 48 rotates around the second axial line 48A as a pivot to open and close with respect to the second partial region LC. The second axial line 48A extends in a direction intersecting with the longitudinal direction of the roller shaft 44A. The first guide member 47 opens in conjunction with the opening action of the second guide member 48.

Thus, in the case where a portion of the first guide member 47 overlaps a portion of the second guide member 48, which is located below the first guide member 47, when the first and second guide members 47 and 48 are in their open positions, the second guide member 48 can be opened without performing the operation of opening the first guide member 47 separately ahead. In other words, even when an attempt is made to open the second guide member 48 ahead of the first guide member 47, the operation of opening the second guide member 48 is not limited by the first guide member 47. Therefore, the operation of opening the second guide member 48 can also serve as the operation of opening the first guide member 47. As a result, the number of operation steps for opening the two guide members 47 and 48, the directions of the axes of rotation for opening and closing of which intersect with each other, for the purpose of maintenance, can be reduced.

Figure 2:
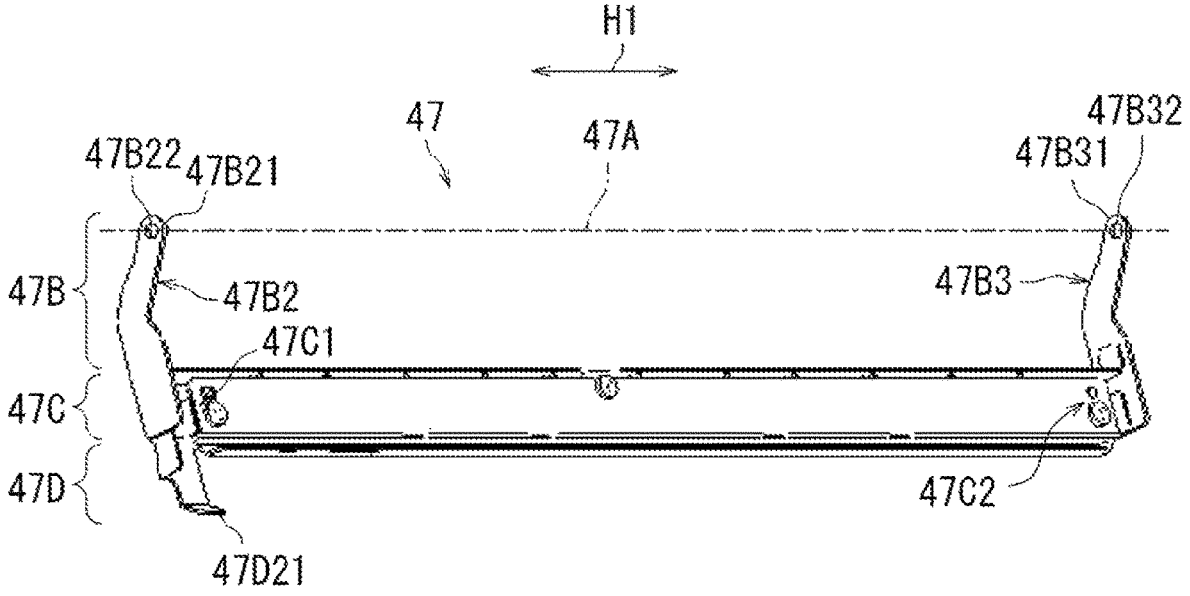
FIG. 2 is a perspective view showing a first guide member of a second conveyance section.

Next, a configuration of the first guide member 47 will be described in detail with reference to FIG. 1 and additionally FIG. 2. FIG. 2 is a perspective view showing the first guide member 47.

The first guide member 47 has a first body portion 47C, a first base end portion 47B, and a first tip portion 47D. The first body portion 47C is in the shape of, for example, a transversely elongated, generally rectangular board. The first body portion 47C extends in a direction parallel to the first axial line 47A. The first axial line 47A extends in a first direction H1.

The first base end portion 47B intersects with the first axial line 47A. The first base end portion 47B is located closer to the first axial line 47A than is the first body portion 47C, extending from the first body portion 47C.

The first base end portion 47B has a first arm portion 47B2 and a second arm portion 47B3. The first arm portion 47B2 is located facing the second arm portion 47B3 with the first body portion 47C interposed therebetween. The first arm portion 47B2 and the second arm portion 47B3 protrude from end portions 47C1 and 47C2, respectively, in the longitudinal direction of the first body portion 47C, in a direction orthogonal to the first direction H1. A first through hole 47B22 is formed in a tip portion 47B21 of the first arm portion 47B2. A second through hole 47B32 is formed in a tip portion 47B31 of the second arm portion 47B3. The first and second through holes 47B22 and 47B32 are located on the first axial line 47A.

The first tip portion 47D is located opposite to the first base end portion 47B with the first body portion 47C interposed therebetween. The first tip portion 47D has a tongue-shaped member 47D21.

The tongue-shaped member 47D21 protrudes from the first body portion 47C in a direction away from the first axial line 47A. Specifically, the tongue-shaped member 47D21 protrudes from the end portion 47C1 of the first body portion 47C in a direction orthogonal to the first direction H1, in a direction away from the first axial line 47A. The tongue-shaped member 47D21 is in the shape of, for example, a thin plate.

Figure 3A:
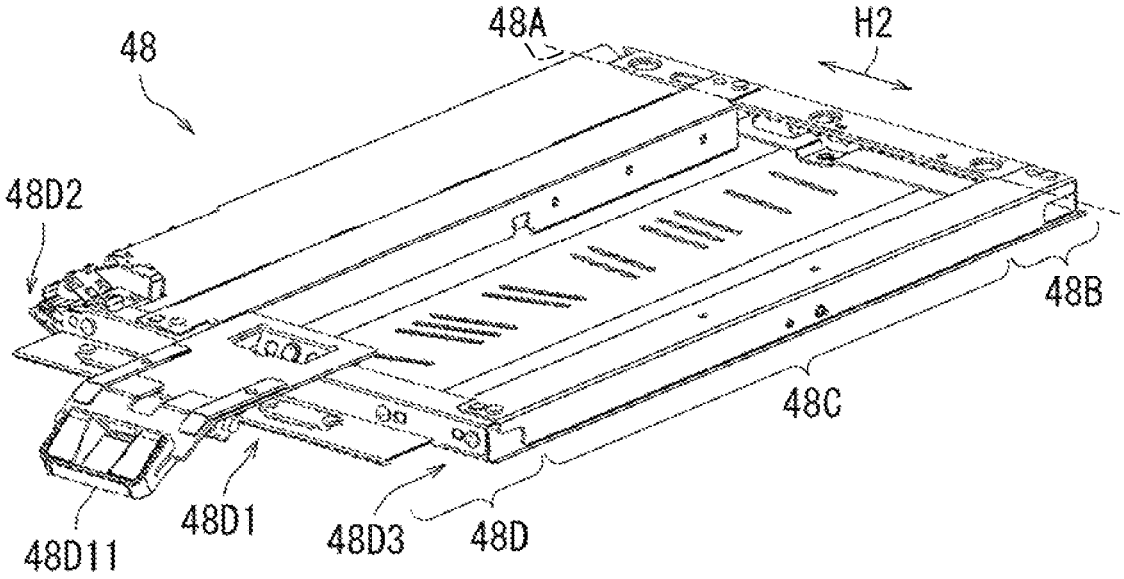
FIG. 3A is a perspective view showing a second guide member of the second conveyance section.
Figure 3B:
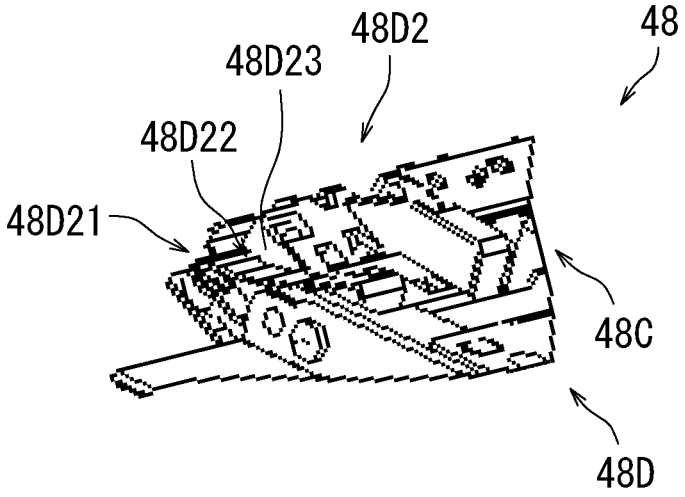
FIG. 3B is a partially enlarged perspective view of a second tip portion of the second guide member.

Next, a configuration of the second guide member 48 will be described in detail with reference to FIGS. 1 and 2 and additionally FIGS. 3A and 3B. FIG. 3A is a perspective view showing the second guide member 48. FIG. 3B is a partially enlarged perspective view of a second tip portion 48D of the second guide member 48.

As shown in FIG. 3A, the second guide member 48 has a second body portion 48C, a second base end portion 48B, and a second tip portion 48D. The second body portion 48C is in the shape of, for example, a generally rectangular board. The second body portion 48C extends in a direction orthogonal to the second axial line 48A. The second axial line 48A extends in a second direction H2.

The second base end portion 48B is adjacent to the second axial line 48A. The second base end portion 48B is located closer to the second axial line 48A than is the second body portion 48C, and extends along the second body portion 48C. In other words, the second base end portion 48B is located at the second axial line 48A, and extends in the second direction H2.

The second tip portion 48D is located opposite to the second base end portion 48B with the second body portion 48C interposed therebetween. The second tip portion 48D has a second tip base portion 48D1, a first corner portion 48D2, and a second corner portion 48D3. The second tip base portion 48D1, which extends in a transverse direction of the second body portion 48C, is connected to the first and second corner portions 48D2 and 48D3. The second tip base portion 48D1 has a lever member 48D11 that is held by a user. The lever member 48D11 protrudes from the second body portion 48C in a direction away from the second axial line 48A. The first corner portion 48D2 is located opposite to the second corner portion 48D3 with the second tip base portion 48D1 interposed therebetween.

As shown in FIG. 3B, the first corner portion 48D2 has a contact portion 48D21. The contact portion 48D21 can be brought into contact with the tongue-shaped member 47D21 (see FIG. 2). The contact portion 48D21 has a contact surface 48D22 and a contact side wall 48D23. The contact surface 48D22 faces the tongue-shaped member 47D21. The contact surface 48D22 may be formed in the shape of a gentle staircase. The contact side wall 48D23 is disposed in a vertical position at an end portion closer to the second body portion 48C of the contact surface 48D22. For example, the contact side wall 48D23 can be brought into contact with a side surface of the tongue-shaped member 47D21.

Figure 4:
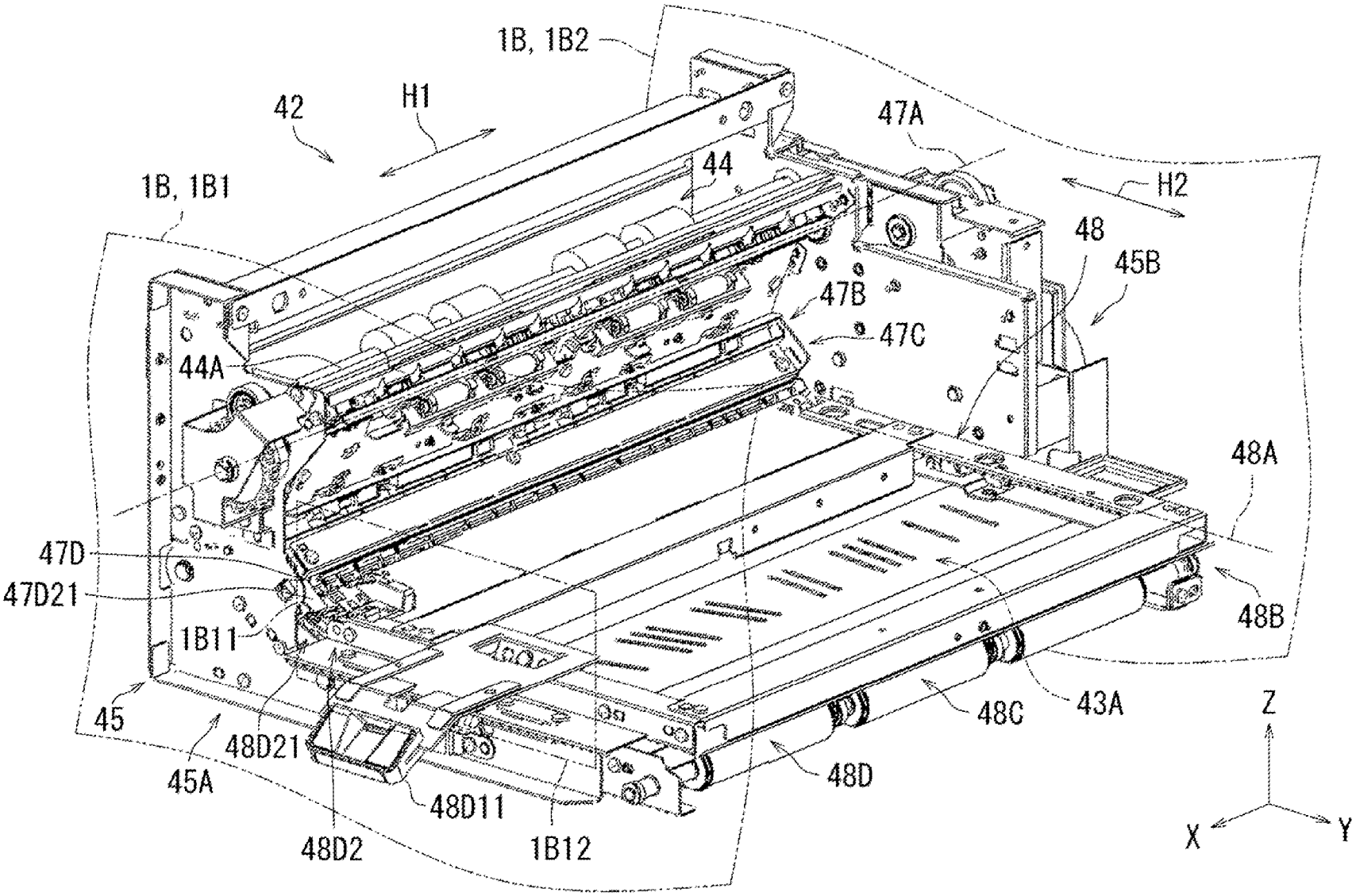
FIG. 4 is a perspective view showing the second conveyance section and a portion of a side wall portion.

Next, the frame member 45, a first side wall portion 1B1, and a second side wall portion 1B2 will be described with respect to FIGS. 1-3B and additionally FIG. 4. FIG. 4 is a perspective view showing the second conveyance section 42 and a portion of the side wall portion 1B. FIG. 4 shows the closed state of the first guide member 47 and the closed state of the second guide member 48.

As shown in FIG. 4, the frame member 45 includes a first frame member 45A and a second frame member 45B. The frame member 45 is fixed to the body housing 1. The first and second frame members 45A and 45B are located facing each other with a placement surface 43A interposed therebetween. The first frame member 45A has a column-shaped member (not shown) that protrudes toward the second frame member 45B and has a central axis coinciding with the first axial line 47A.

The second frame member 45B is located including the second axial line 48A. The second frame member 45B has a column-shaped member (not shown) that protrudes toward the first frame member 45A and has a central axis coinciding with the first axial line 47A. The second frame member 45B also has a column-shaped member (not shown) that has a central axis coinciding with the second axial line 48A.

The first base end portion 47B of the first guide member 47 is attached to the respective column-shaped members of the first and second frame members 45A and 45B such that the first base end portion 47B can rotate around the first axial line 47A as a pivot. Specifically, the column-shaped member of the first frame member 45A is inserted into the first through hole 47B22 of the first arm portion 47B2 (see FIG. 2). Meanwhile, the column-shaped member of the second frame member 45B is inserted into the second through hole 47B32 of the second arm portion 47B3.

The second base end portion 48B of the second guide member 48 is attached to the column-shaped member of the second frame member 45B such that the second base end portion 48B can rotate around the second axial line 48A as a pivot.

The first side wall portion 1B1 is located in parallel to and facing the second side wall portion 1B2 with the second conveyance section 42 interposed therebetween. The first side wall portion 1B1 has an opening portion 1B11. The opening portion 1B11 is equivalent to an example of the "opening." The opening portion 1B11 is, for example, a rectangular opening. The opening portion 1B11 may have an openable and closeable lid member, or may be covered by a cladding member of the first side wall portion 1B 1.

The second base end portion 48B is located deeper from the opening portion 1B11 than is the second tip portion 48D in a direction along the first axial line 47A. In the closed state of the second guide member 48, the lever member 48D11 is located at a lower end 1B12 of the opening portion 1B11.

Figure 5A:
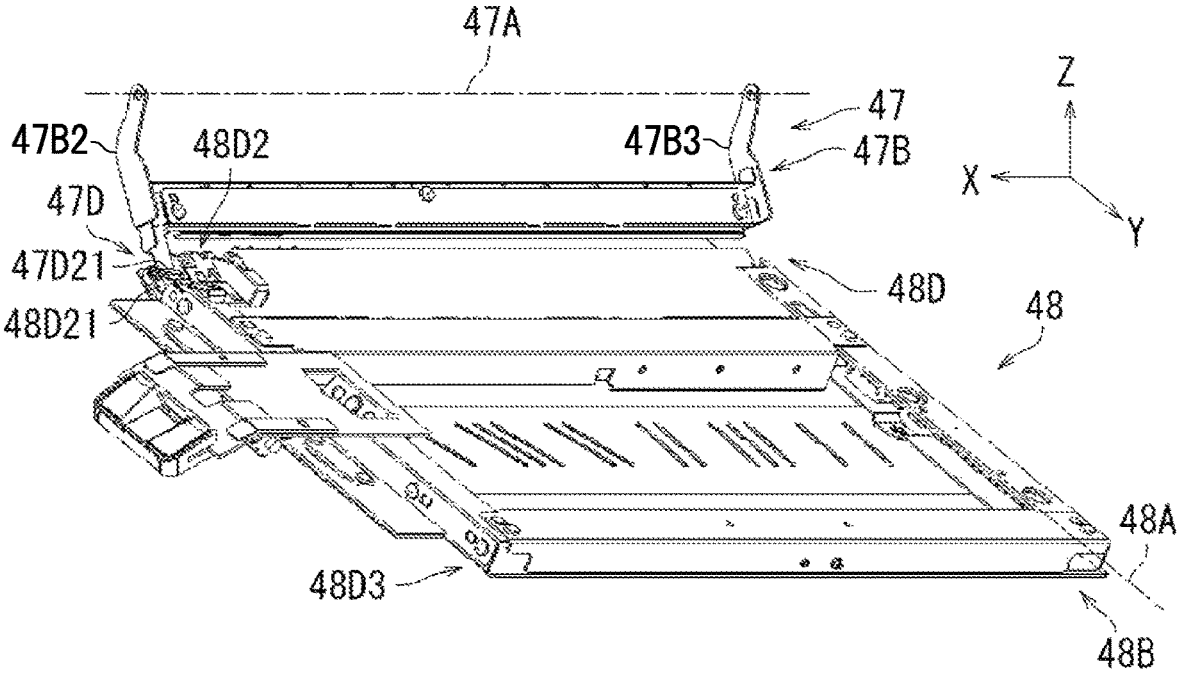
FIGS. 5A and 5B are perspective views showing the first and second guide members.
Figure 5B:
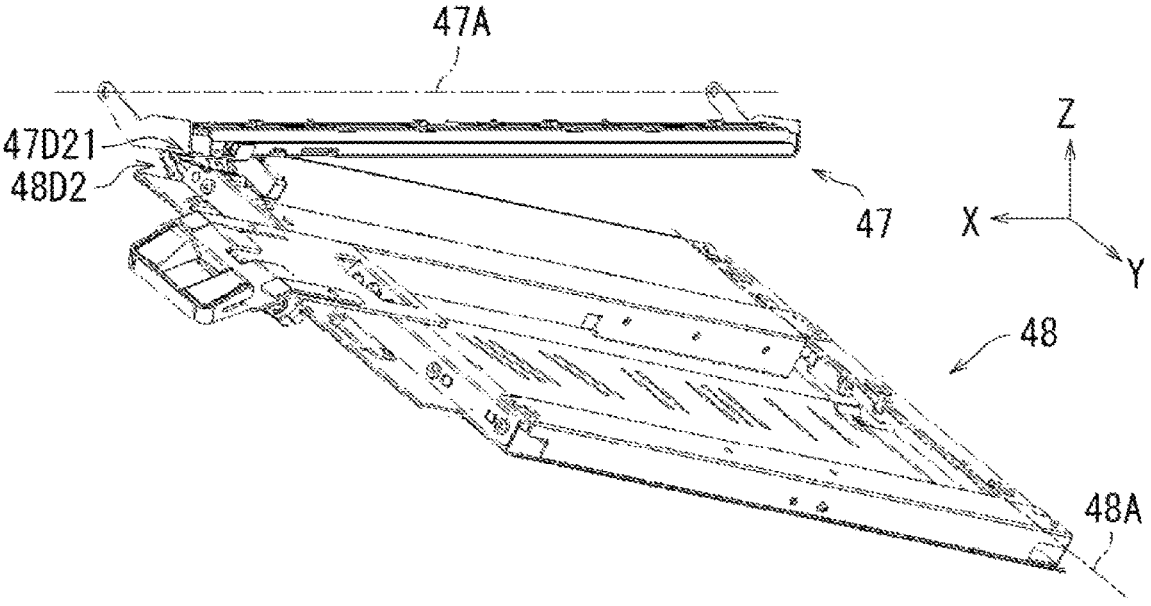

Next, locations and movements of the first and second guide members 47 and 48 will be further described with reference to FIGS. 1-4 and additionally FIGS. 5A, 5B, and 6. FIGS. 5A and 5B are perspective view showing the first and second guide members 47 and 48.

FIG. 5A shows the closed state of the first guide member 47 and the closed state of the second guide member 48. The first tip portion 47D of the first guide member 47 is located vertically above the second tip portion 48D of the second guide member 48. Specifically, the first arm portion 47B2 of the first guide member 47 is located farther from the second base end portion 48B of the second guide member 48 than is the second arm portion 47B3 of the first guide member 47. The first corner portion 48D2 of the second guide member 48 is located closer to the first base end portion 47B of the first guide member 47 than is the second corner portion 48D3 of the second base end portion 48B. At this time, the contact portion 48D21 of the second guide member 48 is in contact with a lower surface of the tongue-shaped member 47D21 of the first guide member 47.

FIG. 5B shows the open state of the first guide member 47 and the open state of the second guide member 48. When the second guide member 48 rotates upward around the second axial line 48A as a pivot, the second guide member 48 transitions from the closed state to the open state. The first corner portion 48D2 moves vertically upward around the second axial line 48A as a pivot, pressing the lower surface of the tongue-shaped member 47D21. The angle by which the second guide member 48 rotates is up to, for example, 10°. The angle by which the first guide member 47 rotates in conjunction with the rotation of the second guide member 48 is, for example, 70°.

Meanwhile, the transition of the second guide member 48 from the open state to the closed state is accompanied by the transition of the first guide member 47 from the open state to the closed state. Specifically, the second guide member 48 performs backward rotation around the second axial line 48A as a pivot due to its own weight. The downward movement of the first corner portion 48D2 is accompanied by the backward rotation of the first guide member 47 around the first axial line 47A as a pivot due to its own weight.

Figure 6:
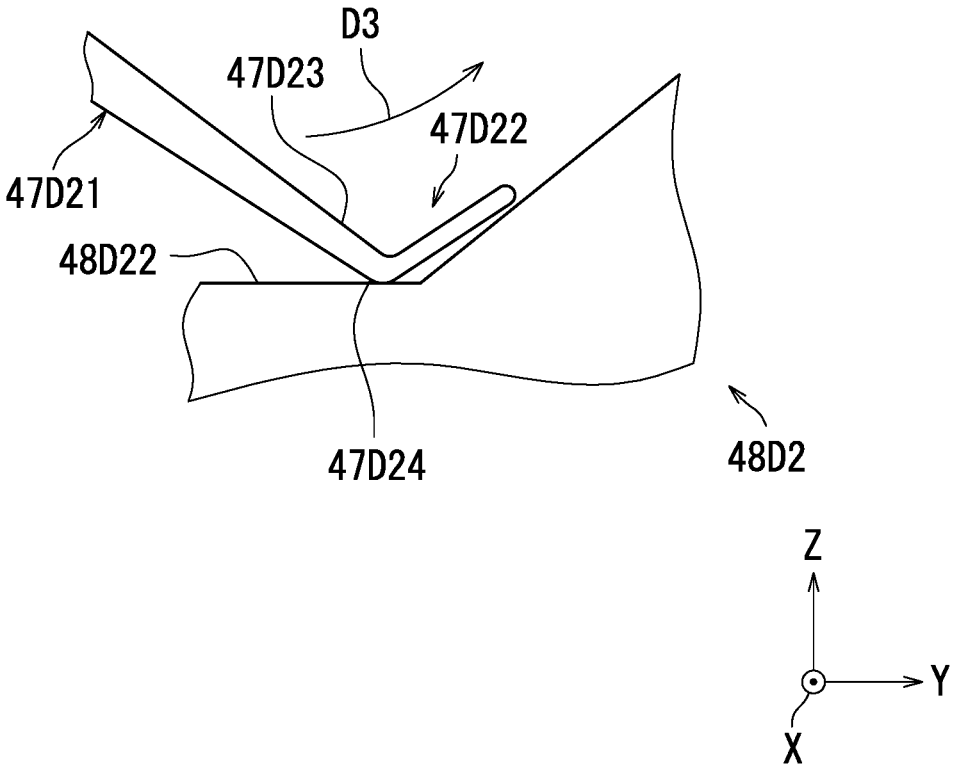
FIG. 6 is a side view showing a portion of a tongue-shaped member of the first guide member and a portion of a first corner portion of the second guide member.

FIG. 6 is a side view showing a portion of the tongue-shaped member 47D21 and a portion of the first corner portion 48D2. A tip portion 47D22 of the tongue-shaped member 47D21 is bent from a lower surface 47D24 toward an upper surface 47D23 of the tongue-shaped member 47D21. The contact surface 48D22 of the first corner portion 48D2 is slid on the lower surface 47D24 of the tongue-shaped member 47D21, pressing the lower surface 47D24 of the tongue-shaped member 47D21, so that the tongue-shaped member 47D21 is moved in a sliding direction D3.

As described above with reference to FIGS. 1-6, in this embodiment, the first tip portion 47D is located vertically above the second tip portion 48D. Thus, the end portions of the first and second guide members 47 and 48 are located overlapping in the vertical direction. When the second guide member 48 performs forward rotation, the second tip portion 48D pushes the first tip portion 47D upward. Thus, the second tip portion 48D pushes upward the portion of the first guide member 47 that is located away from the first axial line 47A as the axis of rotation. This allows the user to rotate the second guide member 48 forward using a smaller force.

In addition, in this embodiment, the first corner portion 48D2 moves vertically upward around the second axial line 48A as a pivot, pressing the lower surface of the first tip portion 47D. Therefore, in the case where the first and second guide members 47 and 48 are each in the shape of, for example, a generally plate, the first and second guide members 47 and 48 can be allowed to move in conjunction with each other without the need of a complicated configuration.

In addition, in this embodiment, the first tip portion 47D preferably has the tongue-shaped member 47D21. The contact portion 48D21 of the first corner portion 48D2 is brought into contact with the tongue-shaped member 47D21 from below the tongue-shaped member 47D21. Therefore, when the first corner portion 48D2 presses the lower surface of the first tip portion 47D, the first corner portion 48D2 can be substantially prevented from being unnecessarily brought into contact with portions other than the tongue-shaped member 47D21 of the lower surface of the first tip portion 47D. As a result, unsteady movement can be substantially prevented when the first and second guide members 47 and 48 move in associated with each other.

In addition, in this embodiment, the tip portion 47D22 of the tongue-shaped member 47D21 is preferably bent from the lower surface 47D24 toward the upper surface 47D23 of the tongue-shaped member 47D21. The first corner portion 48D2 can lift the first guide member 47 while sliding on the lower surface of the tongue-shaped member 47D21. Therefore, when the second guide member 48 is opened, the tip of the first tip portion 47D can be substantially prevented from being caught by the upper surface of the first corner portion 48D2.

Figure 7:
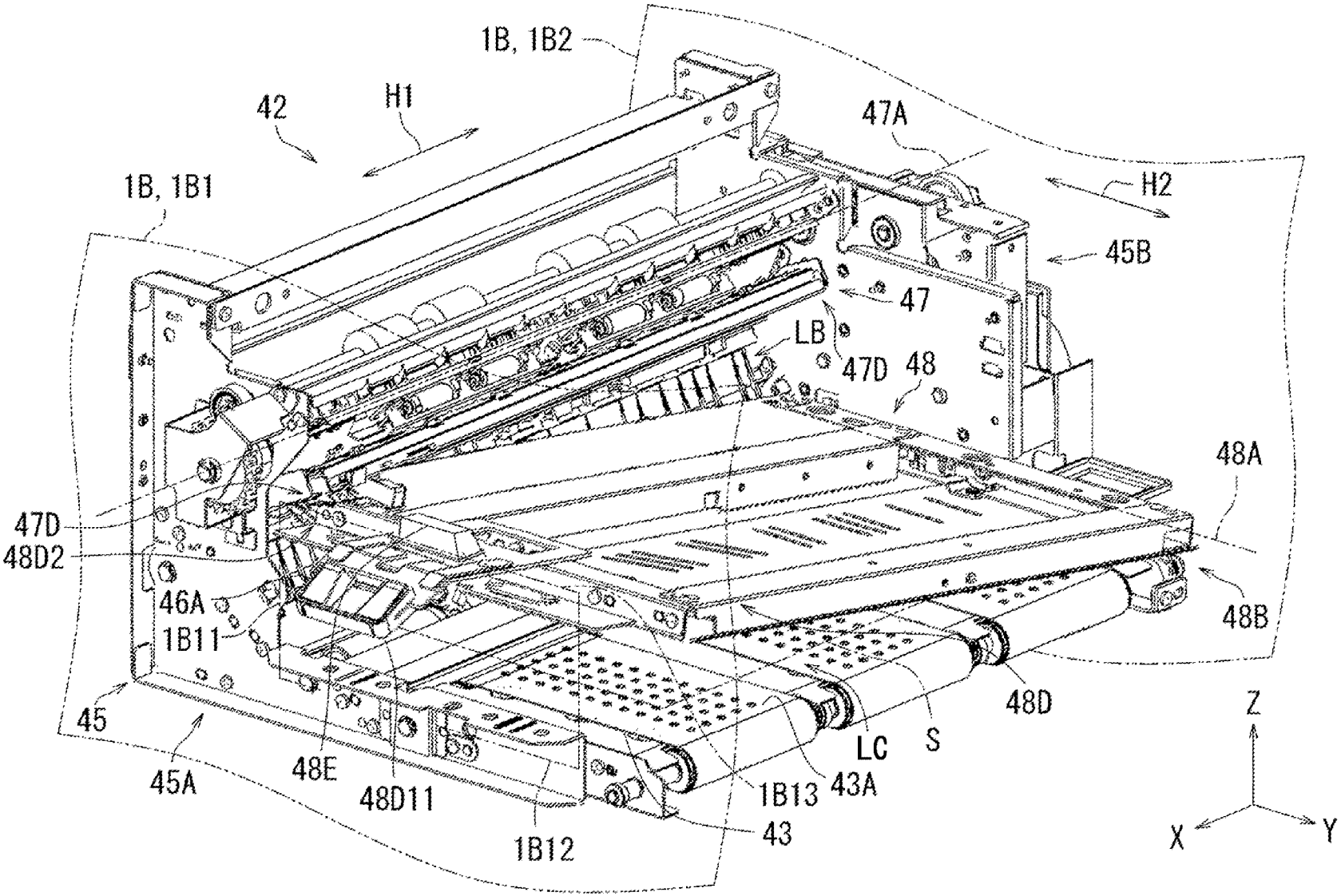
FIG. 7 is a perspective view showing the second conveyance section and a portion of the side wall portion.

Next, the first and second partial regions LB and LC of the conveyance path L will be described with reference to FIGS. 1-6 and additionally FIG. 7. FIG. 7 is a perspective view showing the second conveyance section 42 and a portion of the side wall portion 1B.

FIG. 7 shows the open state of the first guide member 47 and the open state of the second guide member 48. The first and second partial regions LB and LC of the conveyance path L are located between the first side wall portion 1B1 and the second side wall portion 1B2, facing the opening portion 1B11. The length in the longitudinal direction of the first guide member 47 corresponds to the width in the first direction H1 of the first partial region LB. The length in the longitudinal direction of the second guide member 48 corresponds to the width in the first direction H1 of the second partial region LC.

The first corner portion 48D2 moves around the second axial line 48A as a pivot, within a distance between an upper end 1B13 and a lower end 1B12 of the opening portion 1B11. The distance between the upper end 1B13 and the lower end 1B12 is, for example, 80 mm. When the second guide member 48 performs forward rotation, the first guide member 47 rotates in conjunction with the forward rotation of the second guide member 48, so that the first partial region LB and the second partial region LC are exposed (opened) to the outside through the opening portion 1B11. When the first partial region LB is exposed to the outside, the placement surface 43A of the second conveyance belt 43 in the first partial region LB is exposed.

For example, in this embodiment, when the sheet S being conveyed is jammed in the first partial region LB or the second partial region LC, the sheet S may be stuck in the vicinity of the first branching guide member 46A and on the placement surface 43A. In general, such jamming is likely to occur at curved portions of the conveyance path. In this embodiment, in a jamming process of removing the jammed sheet S from a position where the sheet S is stuck, the user lifts the lever member 48D11 from the position of the lower end 1B12 of the opening portion 1B11 to the position of the upper end 1B13 of the opening portion 1B11. The user is allowed to remove the jammed sheet S by inserting their hand from the opening portion 1B11 into below the first and second guide members 47 and 48.

As described above with reference to FIGS. 1-7, in this embodiment, the frame member 45 of the second conveyance section 42 is fixed to the body housing 1. The first and second base end portions 47B and 48B are each attached to the frame member 45 such that the first and second base end portions 47B and 48B can each rotate. The second base end portion 48B is located deeper from the opening portion 1B11 of the first side wall portion 1B1 than is the second tip portion 48D in a direction along the first axial line 47A. The first corner portion 48D2 moves around the second axial line 48A as a pivot, within the distance between the upper end 1B13 and the lower end 1B12 of the opening portion 1B11. As a result, in the case where the first and second partial regions LB and LC are accessed through an opening having a narrow width, the first and second guide members 47 and 48 can be easily opened. Therefore, when the two guide members 47 and 48, the directions of the axes of rotation for opening and closing of which intersect with each other, are open for maintenance, the internal mechanism can be substantially prevented from being unnecessarily exposed, and the number of operation steps can be reduced.

Note that as shown in FIG. 7, the second guide member 48 preferably has a holding member 48E. The holding member 48E keeps the second guide member 48 in the open state. The holding member 48E is, for example, a magnetic member including a magnet. When the user lifts the lever member 48D11 from the position of the lower end 1B12 of the opening portion 1B11 to the position of the upper end 1B13 of the opening portion 1B11, the holding member 48E removably sticks to, for example, the lower surface of the reverse conveyance section 49, which is located above the holding member 48E (see FIG. 1), by means of the force of the magnet. As a result, the open state of the second guide member 48 is kept. Therefore, the convenience of the user during maintenance can be improved.

In addition, the first guide member 47 can rotate, but not in conjunction with the second guide member 48, i.e.

separately from the second guide member 48. Specifically, in the closed state of the second guide member 48, the first guide member 47 alone is allowed to perform forward rotation. Therefore, when jamming occurs only in the first partial region LB, the first guide member 47 can be operated such that only the first partial region LB is exposed to the outside. As a result, the convenience of the user during maintenance can be further improved.

In the foregoing, an embodiment of the present disclosure has been described with reference to the drawings (FIGS. 1-7). Note that the present disclosure is not limited to the above embodiment, and may be applied to various alternative embodiments without departing the spirit and scope of the present disclosure. A plurality of components disclosed in the above embodiment may be combined as appropriate to form various disclosures. For example, several components of all the components described in the embodiment may be removed. Furthermore, some components of different embodiments may be combined as appropriate. The drawings mainly illustrate the components schematically for ease of understanding. The thicknesses, lengths, number, etc., of the components shown are not to scale for the sake of convenience of illustration. The materials, shapes, dimensions, etc., of the components illustrated in the above embodiments are merely for illustrative purposes and are not particularly limited, and may be changed and modified without substantially departing the configuration of the present disclosure.

(1) As described above with reference to FIGS. 1-7, the image forming apparatus 100 is assumed as an inkjet recording-type multifunction peripheral. The present disclosure is not limited to this. The image forming apparatus 100 may, for example, be an electrographic device. For example, in the case of an electrographic multifunction peripheral, the image forming section 3 may include a photosensitive drum, a charging device, an exposure device, a developing device, a replenishing device, a transfer device, a cleaning device, an electrostatic elimination device, and a fusing device.

(2) As described above with reference to FIGS. 1-7, the first and second guide members 47 and 48 are located in the second conveyance section 42. The present disclosure is not limited to this. The first guide member 47, which rotates around the first axial line 47A as a pivot, and the second guide member 48, which rotates around the second axial line 48A intersecting with the first axial line 47A as viewed above, as a pivot, are only required to be located in the conveyance path L, depending on the shape of the conveyance path L.

What is claimed is:

1. An image forming apparatus comprising:

an image forming section configured to form an image on a sheet; and a conveyance section configured to form a conveyance path for the sheet and convey the sheet in a conveyance direction, wherein the conveyance section includes a conveyance roller configured to rotate around a roller shaft as a center, the roller shaft extending in a direction orthogonal to the conveyance direction, and a guide member, the guide member includes a first guide member configured to rotate around a first axial line as a pivot to open and close with respect to a first partial region of an entire region of the conveyance path, and a second guide member configured to rotate around a second axial line as a pivot to open and close with respect to a second partial region of the entire region, the second partial region being different from the first partial region, the first axial line extends in a direction parallel to a longitudinal direction of the roller shaft, the second axial line extends in a direction intersecting with the longitudinal direction, the first guide member opens in conjunction with an opening action of the second guide member, the first guide member has a first base end portion intersecting with the first axial line, a first body portion, and a first tip portion located opposite to the first base end portion with the first body portion interposed therebetween, the second guide member has a second base end portion adjacent to the second axial line, a second body portion, and a second tip portion located opposite to the second base end portion with the second body portion interposed therebetween, and the first tip portion located vertically above the second tip portion.

2. The image forming apparatus according to claim 1, wherein the second tip portion moves vertically upward around the second axial line as a pivot, pressing a lower surface of the first tip portion.

3. The image forming apparatus according to claim 2, wherein the first tip portion has a tongue-shaped member protruding from the first body portion in a direction away from the first axial line, and the second tip portion has a contact portion configured to be brought into contact with a lower surface of the tongue-shaped member.

4. The image forming apparatus according to claim 3, wherein a tip portion of the tongue-shaped member is bent from the lower surface of the tongue-shaped member toward an upper surface of the tongue-shaped member.

5. The image forming apparatus according to claim 1 further comprising:

a body housing configured to accommodate the image forming section and the conveyance section, wherein the body housing includes a first side wall portion and a second side wall portion located in parallel to and facing each other with the conveyance section interposed therebetween, the conveyance section includes a placement surface for the sheet in the conveyance path, and a frame member fixed to the body housing, the first and second base end portions are each attached to the frame member such that the first and second base end portions are allowed to rotate, the first side wall portion has an opening, the first and second partial regions are located between the first and second side wall portions, facing the opening, the second base end portion is located deeper from the opening than is the second tip portion in a direction along the first axial line, and the second tip portion moves around the second axial line as a pivot, within a distance between an upper end and a lower end of the opening.

6. The image forming apparatus according to claim 1, wherein the first guide member is allowed to rotate separately from the second guide member.

7. An image forming apparatus comprising:

an image forming section configured to form an image on a sheet; and a conveyance section configured to form a conveyance path for the sheet and convey the sheet in a conveyance direction, wherein the conveyance section includes a conveyance roller configured to rotate around a roller shaft as a center, the roller shaft extending in a direction orthogonal to the conveyance direction, and a guide member, the guide member includes a first guide member configured to rotate around a first axial line as a pivot to open and close with respect to a first partial region of an entire region of the conveyance path, and a second guide member configured to rotate around a second axial line as a pivot to open and close with respect to a second partial region of the entire region, the second partial region being different from the first partial region, the first axial line extends in a direction parallel to a longitudinal direction of the roller shaft, the second axial line extends in a direction intersecting with the longitudinal direction, the first guide member opens in conjunction with an opening action of the second guide member, the second guide member has a holding member configured to keep the second guide member in an open state, and the holding member includes a magnet.

8. The image forming apparatus according to claim 7, wherein the first guide member is allowed to rotate separately from the second guide member.

* * * * *